US009080329B2

(12) United States Patent
Döhring et al.

(10) Patent No.: US 9,080,329 B2
(45) Date of Patent: Jul. 14, 2015

(54) SURFACE COVERING COMPRISING LAMINATE PANELS AND AN EXTRANEOUS LOCKING ELEMENT

(75) Inventors: Dieter Döhring, Groβenhain (DE); Michael Gründel, Lauchhammer (DE)

(73) Assignee: Kronoplus Technical AG, Niederteufen (CH)

( * ) Notice: Subject to any disclaimer, the term of this patent is extended or adjusted under 35 U.S.C. 154(b) by 0 days.

(21) Appl. No.: 13/880,549

(22) PCT Filed: Oct. 20, 2010

(86) PCT No.: PCT/EP2010/065822

§ 371 (c)(1), (2), (4) Date: Jul. 8, 2013

(87) PCT Pub. No.: WO2012/052055

PCT Pub. Date: Apr. 26, 2012

(65) Prior Publication Data

US 2013/0283719 A1 Oct. 31, 2013

(51) Int. Cl.

| | |
|---|---|
| ***E04B 2/00*** | (2006.01) |
| ***E04F 15/02*** | (2006.01) |
| ***E04F 13/08*** | (2006.01) |

(52) U.S. Cl.

CPC ..... *E04F 15/02038* (2013.01); *E04F 13/0894* (2013.01); *E04F 15/02* (2013.01);
(Continued)

(58) Field of Classification Search

CPC ..... E04F 15/02; E04F 13/0873; E04F 2201/0576; E04F 2201/0588
USPC ..... 52/578, 582.1, 582.2, 586.1, 591.5
See application file for complete search history.

(56) References Cited

U.S. PATENT DOCUMENTS 7,169,460 B1 * 1/2007 Chen et al. ..... 428/195.1
7,621,092 B2 * 11/2009 Groeke et al. ..... 52/586.1
(Continued)

FOREIGN PATENT DOCUMENTS

CN 1243896 C 3/2006
CN 1880702 A 12/2006
(Continued)

OTHER PUBLICATIONS

International Search Report corresponding to European Application No. PCT/EP2010/065822 dated Jul. 14, 2011.
(Continued)

*Primary Examiner* — Mark Wendell
*Assistant Examiner* — Keith Minter
(74) *Attorney, Agent, or Firm* — Renner, Otto, Boisselle & Sklar, LLP

(57) ABSTRACT

The present invention relates to a surface covering (100) comprising panels (200) and at least one extraneous locking element (300). The panels (200) are provided with respective longitudinal and transverse coupling means (400, 500) which are adapted to connect similar panels (200) at corresponding adjacent edges (211, 211', 213, 213'). The transverse coupling means (500) are adapted to form a channel (501) in coupled condition which is adapted to receive the extraneous locking element (300). When inserted into the channel (501) formed by the transverse coupling means (500) of panels (200) in a first row (206), the extraneous locking element is adapted to extend at least partially into the groove (430) of an adjacent parallel panel in the second row (207), such that a lower surface (305) of the extraneous locking element (300) is in contact with a lower lip contact portion (433), and the upper surface (307) of the extraneous locking element (300) is in contact with an upper lip contact portion (437).

44 Claims, 4 Drawing Sheets

(52) U.S. Cl.
CPC .... *E04F 13/0873* (2013.01); *E04F 2201/0138* (2013.01); *E04F 2201/0153* (2013.01); *E04F 2201/057* (2013.01); *E04F 2201/0523* (2013.01); *E04F 2201/0541* (2013.01); *E04F 2201/0576* (2013.01); *E04F 2201/0588* (2013.01)

(56) References Cited

U.S. PATENT DOCUMENTS

| | | | | |
|---|---|---|---|---|
| 7,634,884 | B2 * | 12/2009 | Pervan et al. | 52/582.1 |
| 7,908,815 | B2 * | 3/2011 | Pervan et al. | 52/582.1 |
| 7,913,471 | B2 * | 3/2011 | Pervan | 52/590.2 |
| 7,954,295 | B2 * | 6/2011 | Pervan | 52/592.1 |
| 8,079,196 | B2 * | 12/2011 | Pervan | 52/586.2 |
| 8,234,831 | B2 * | 8/2012 | Pervan | 52/588.1 |
| 8,381,476 | B2 * | 2/2013 | Hannig | 52/582.1 |
| 8,387,327 | B2 * | 3/2013 | Pervan | 52/586.2 |
| 8,448,402 | B2 * | 5/2013 | Pervan et al. | 52/582.1 |
| 8,677,714 | B2 * | 3/2014 | Pervan | 52/592.1 |
| 8,689,512 | B2 * | 4/2014 | Pervan | 52/586.1 |
| 2002/0095894 | A1 * | 7/2002 | Pervan | 52/391 |
| 2004/0261348 | A1 * | 12/2004 | Vulin | 52/578 |
| 2005/0028474 | A1 * | 2/2005 | Kim | 52/578 |
| 2005/0144881 | A1 * | 7/2005 | Tate et al. | 52/578 |
| 2006/0032175 | A1 * | 2/2006 | Chen et al. | 52/578 |
| 2006/0150557 | A1 * | 7/2006 | Eisermann | 52/578 |
| 2008/0000187 | A1 * | 1/2008 | Pervan | 52/588.1 |
| 2008/0168730 | A1 | 7/2008 | Pervan et al. | |
| 2009/0101236 | A1 * | 4/2009 | Boucke | 144/350 |
| 2010/0319290 | A1 * | 12/2010 | Pervan et al. | 52/582.2 |
| 2011/0016815 | A1 * | 1/2011 | Yang | 52/396.04 |
| 2011/0036041 | A1 * | 2/2011 | Liu | 52/588.1 |
| 2011/0162312 | A1 | 7/2011 | Schulte | |
| 2011/0197535 | A1 * | 8/2011 | Baker et al. | 52/588.1 |
| 2011/0209427 | A1 * | 9/2011 | Lawrence | 52/309.1 |
| 2011/0225921 | A1 | 9/2011 | Schulte | |
| 2012/0042595 | A1 * | 2/2012 | De Boe | 52/309.13 |
| 2012/0096798 | A1 * | 4/2012 | Ko | 52/578 |
| 2014/0020324 | A1 * | 1/2014 | Pervan | 52/588.1 |
| 2014/0041332 | A1 * | 2/2014 | Speidel et al. | 52/582.2 |
| 2014/0109506 | A1 * | 4/2014 | Pervan et al. | 52/582.2 |
| 2014/0115992 | A1 * | 5/2014 | Griffith | 52/578 |
| 2014/0215949 | A1 * | 8/2014 | Cossette et al. | 52/568 |
| 2014/0223852 | A1 | 8/2014 | Pervan | |

FOREIGN PATENT DOCUMENTS

| | | | |
|---|---|---|---|
| DE | 200 21 780 | U1 | 5/2002 |
| DE | 2020 05020330 | U1 | 4/2006 |
| DE | 102005062982 | B3 | 1/2007 |
| EP | 1669512 | A2 | 6/2006 |
| EP | 1785547 | A2 | 5/2007 |
| EP | 2031148 | A2 | 3/2009 |
| RU | 2291939 | C2 | 1/2007 |
| RU | 2302498 | C2 | 7/2007 |
| RU | 2394137 | C | 7/2007 |
| RU | 2358076 | C1 | 6/2009 |
| WO | 01/51732 | A1 | 7/2001 |
| WO | WO 01/51733 | A1 | 7/2001 |
| WO | 03/016654 | A1 | 2/2003 |
| WO | WO 03095761 | A1 * | 11/2003 |
| WO | 2009/116926 | A1 | 9/2009 |
| WO | 2010 028621 | A1 | 3/2012 |

OTHER PUBLICATIONS

Written Opinion corresponding to European Application No. PCT/EP2010/065822 dated Jul. 14, 2011.

Search Report for corresponding Chinese patent application No. 2010800697167.

European Search Report for corresponding European patent application No. EP 13 17 7540 dated Aug. 18, 2014.

* cited by examiner

SURFACE COVERING COMPRISING LAMINATE PANELS AND AN EXTRANEOUS LOCKING ELEMENT

This application is a national phase of International Application No. PCT/EP2010/065822 filed Oct. 20, 2010 and published in the English language.

1. FIELD OF THE INVENTION

The present invention relates to a surface covering, in particular to a floor, ceiling or wall covering, comprising panels and an extraneous locking element as well as to a method of assembling the same.

2. TECHNICAL BACKGROUND

A variety of different kinds of surface coverings, in particular floor, ceiling or wall coverings are known in the art. In particular for interior applications, wooden panels or panels having the appearance of wood are very popular. In the recent years laminate panels have been developed in particular to be used as flooring panels reproducing the appearance of various kinds of different wood panels.

In general, laminate panels comprise a base or carrier board of MDF, HDF or OSB which is provided on one side with a decor for example to reproduce the appearance of a real wood panel. This decor can be provided either as a printed paper layer or a veneer, or the decor can be directly printed onto the carrier board. Often, these panels are of rectangular shape and can be coupled to each other using complementary coupling means which commonly are formed as integral parts at the panel edges. Thus, similar panels can be connected at corresponding adjacent edges to form for example a floor covering. Among these coupling means in particular various kinds of tongue and groove based coupling means are known which allow for form fitting connections between similar panels by introducing the tongue of one panel into the groove of another panel. To lock the panels together in horizontal and vertical directions, the coupling means are further provided with suitable locking elements, which allow the panels to be firmly locked to each other. Thereby it is possible that such tongue and groove coupling means with additional locking elements can lock respective coupled panels perpendicular to their common connection joint as well as perpendicular and parallel to the panel plane without the need for additional locking means such as for example glue.

In the case of rectangular panels, it is common that panels are provided with two different kinds of coupling means. For example, two opposing longitudinal edges of such panels can be provided with tongue and groove coupling means, which allow similar panels to be connected to each other at adjacent longitudinal edges by angling. In this case, the transverse opposing edges of these panels can be provided with coupling means which allow similar panels to be connectable to each other at adjacent transverse edges by vertical folding. This combination of coupling means allows that a panel can be connected to a row of similar panels by angling this panel around corresponding longitudinal adjacent panel edges, while within the same working step this panel is connected to neighbouring panels by vertical folding to corresponding adjacent transverse panel edges.

An example of such a tongue and groove coupling mechanism is described in the German patent application DE 199 29 896 A1. The DE'896 describes panels which are provided at opposing transverse edges with coupling means which allow for coupling of panels by vertical folding. The transverse coupling means described therein are hook-shaped coupling members which can be formed integrally with the transverse panel edges. Upon connection of the panels, these hook-shaped coupling members interlock, thereby coupling the panels perpendicular to the transverse panel connection joint and parallel to the panel plane. Each of these hook-shaped coupling members is provided with a locking element to provide a coupling of the panels also in a direction perpendicular to the panel plane. However, if the connection is subjected to pressure, e.g. when a person stands on the panel, it is still possible that panel edges and in particular the corners of connected panels are deflected downwards.

A further development of such coupling mechanisms is described in the WO 01/51732 A1. This document describes tongue and groove coupling means which are similar to the above described hook-shaped coupling members which can be provided on transverse edges of panels. Upon coupling of panels at corresponding transverse edges, a transverse tongue of one panel is inserted into a corresponding groove of another panel by vertical folding. To increase the stability of this connection, the WO'732 discloses to insert an extraneous locking element into a channel, which is formed by the transverse coupling means. To form this channel, a recess is provided in the transverse tongue which in coupled condition, when two panels are connected to each other, opposes a corresponding recess provided in an adjacent transverse groove. After coupling two panels, the extraneous locking element is inserted into this channel to lock the two panels in a direction perpendicular to their transverse edges and perpendicular to the panel plane.

Similar coupling mechanisms in which extraneous locking elements are used to lock the transverse edges of panels with each other are e.g. known from WO 2003/016654 A1 and WO 2007/079845 A1. All the known solutions have in common that they only provide a secure connection at the transverse sides, however, the corners of the connected panels cannot be locked thereby.

A generally known difficulty which can arise in the case of surface coverings consisting of panels as described above is instability at the interconnection zones where three connected panels met. The reason for that is that the corners of such panels, i.e. where longitudinal coupling means and transverse coupling means meet, are not provided with any coupling means for manufacturing reasons. Thereby, no tight locking occurs at these corners and the panel surface remains bendable in this area.

It is an object of the present invention to improve the state of the art by providing an improved surface covering with an improved way of coupling panels, as for example laminate panels for surface coverings. It is in particular a further object of the present invention to provide more reliable coupling means, which offer an improved interconnection at the corners of the panels. It is an even further object of the present invention to provide an improved extraneous locking element which facilitates the laying process and reduces the amount of deficient products.

These and other objects which become apparent upon reading the following description are solved by a surface covering according to claim 1 and an extraneous locking element according to claim 44.

3. SUMMARY OF THE INVENTION

According to the invention, a surface covering, for example a flooring, ceiling or wall covering, is provided comprising panels and at least one extraneous locking element. Preferably, the panels are laminate panels comprising HDF, MDF, OSB or are made of wood. The panels can be provided with a decor, as e.g. a real wood imitation, a stone imitation or a ceramic imitation, in form of a separate décor paper or the decor may alternatively be directly printed onto the panels.

Each panel is provided with parallel, opposing longitudinal edges and parallel, opposing transverse edges, whereby these edges are provided with respective longitudinal and transverse coupling means, which preferably are formed as integral components of the panel edges and which serve for connecting similar panels at corresponding adjacent edges. The transverse coupling means are adapted to lock panels perpendicular to adjacent transverse panel edges and parallel to the panel plane, whereby it is prevented that connected panels can be pulled apart from each other in longitudinal directions. When two panels are connected to each other at adjacent transverse edges, the corresponding transverse coupling means form a channel which is adapted to receive the extraneous locking element. This extraneous locking element preferably provides an additional coupling of coupled panels perpendicular to the panel plane at respective transverse edges. In other words, it prevents a movement of connected panels vertical to the panel plane.

The longitudinal coupling means comprise a tongue which is provided on one edge of a panel and a corresponding groove provided on the opposing edge of the same panel, and the longitudinal coupling means are most preferably adapted to be locked with angling, i.e. a tongue of one panel is first inserted into a groove of an adjacent panel under an angle, and secondly the panel is rotated around the common connection edge until the tongue locks into the groove. Thereby, for example a form fitting connection between the panels can be achieved, locking similar panels perpendicular to adjacent longitudinal edges and perpendicular to the plane of the panels as well as parallel to the plane of the panels. Suitable longitudinal coupling means are e.g. described in the co-owned EP 1 157 176, the content of which is incorporated herein by reference.

While the longitudinal coupling means are most preferably adapted to couple panels via an angling motion, advantageously the transverse coupling means are adapted to be locked by vertical folding. By this combination of coupling means a panel can be connected to an adjacent panel in a parallel panel row with its longitudinal edge via angling, while with the same angling motion it is possible to connect the same panel to a further panel with its transverse edge by vertical folding, i.e. by pressing the transverse coupling means of the panel into the corresponding transverse coupling means of a further panel.

To improve the connection of panels at the corners thereof, according to the invention, when two parallel rows of panels are assembled, in between transverse edges of the panels of each row channels are formed by the transverse coupling means. These channels are formed such that upon insertion of the extraneous locking element into a channel of e.g. the first row, the channel will guide the extraneous locking element at least partially into a longitudinal groove of an adjacent parallel panel in the second row of panels. Thereby, as described above, the extraneous locking element couples two panels of the first row at their respective transverse edges and at the same time it couples a further panel in a parallel second row to said two panels of the first row. In other words; the geometrical shapes of the longitudinal and transverse coupling means are in alignment to a certain extend, to allow the same extraneous locking element which locks the transverse edges also to lock the longitudinal edge. Thereby, as will become readily apparent from the figures, also the corners of the thus connected panels will be secured. Since the extraneous locking element is also partially inserted into the groove of the longitudinal edge of a panel in a parallel row, the extraneous locking element provides advantageous additional support for parts of panel surface in the interconnection zone of the panels which would otherwise not be supported by the coupling means.

In order to function properly, i.e. to provide a locking function with the groove of the longitudinal coupling means of a panel in a parallel row, the extraneous locking element is preferably in contact with at least two contact portions of the groove, one associated with the upper lip and the other with the lower lip of the groove. To this end, the lower surface of the extraneous locking element engages a lower lip contact portion provided at the lower lip of said groove and an upper surface of the extraneous locking element engages an upper lip contact portion provided at an upper lip of said groove. Thereby, the extraneous locking element is held in between the contact portions of the groove and offers a locking in at least a direction vertical to the panel plane. This offers the advantage of an improved resistance against pressure applied at the corners of installed panels.

To assure that the extraneous locking element is guided correctly into the groove, it is important that the groove is neither too wide nor too narrow in relation to the shape of the extraneous locking element. Therefore, the lower lip contact portion is positioned at a lower lip contact portion height $h_{lower_lip}$, and the upper lip contact portion is positioned at an upper lip contact portion height $h_{upper_lip}$, and the (vertical) difference between these heights $h_{upper_lip}-h_{lower_lip}$ is essentially equal to an effective thickness $d_{eff}$ of the extraneous locking element. It should be noted that all heights as mentioned herein have to be measured starting from the same horizontal plane, most suitably the underside of the panels, i.e. opposite the decor side.

The effective thickness $d_{eff}$ of the extraneous locking element is the thickness of the portion of the extraneous locking element which is actually inserted into the groove. In other words; while the extraneous locking element may have a changing thickness over its length, the effective thickness is the one of the portion of the locking element actually interengaging with the lips of the groove of the longitudinal coupling means.

To allow for the insertion of the extraneous locking element from the channel formed in between transverse edge of two panels of a first row into the groove of the longitudinal edge of a panel in a second row, it is advantageous if the channel is provided at a suitable height. Therefore, in a preferred embodiment, a bottom of the channel is at a height $h_{bottom}$, which is essentially at the same height as the height $h_{lower_lip}$ of the lower lip contact portion, and a top of the channel is at a height $h_{top}$ which is essentially at the same height as a height $h_{upper_lip}$ of the upper lip contact portion.

To provide the inventive support, the extraneous locking element has to be inserted into a corresponding groove in a suitable way, preferably such that it is fixed, in particular wedged, inside the groove. Therefore, the extraneous locking element can be provided with suitable end portions having an effective thickness $d_{eff}$ which is essentially equal to the above mentioned vertical difference $h_{upper_lip}-h_{lower_lip}$ and preferably slightly larger than said difference. Thereby, the extraneous locking element, respectively the end portion thereof being inserted into the longitudinal groove, can firmly be wedged between the lower lip contact portion and the upper lip contact portion of the groove.

Experience has shown that a suitable effective thickness $d_{eff}$ of the extraneous locking element is between 1 mm to 5 mm, more preferably in between 1.3 mm to 3 mm, even more preferably in between 1.35 mm to 2 mm, and most preferably in between 1.4 mm to 1.5 mm.

Alternatively or in addition, the upper lip contact portion and the lower lip contact portions can be designed such that upon insertion of the extraneous locking element into the groove, the extraneous locking element is wedged in between these contact portions. Therefore, preferably a bottom of the channel formed by the transverse coupling means is at a height $h_{bottom}$ and the lower lip contact portion height $h_{lower_lip}$ is essentially at the same height, but preferably slightly higher than the bottom height of the channel. In a preferred embodiment the height of the lower lip contact portion can exceed the bottom height of the channel up to 1.5 mm. Similarly, in a preferred embodiment it can be advantageous if a top of the channel is at a height $h_{top}$ and the upper lip contact portion height $h_{upper_lip}$ is essentially at the same height, but preferably slightly lower than the top height of the channel. In a preferred embodiment the height of the upper lip contact portion can be lower than the top height of the channel by up to 1.5 mm.

Because a surface covering consists usually of multiple parallel rows of panels, in a preferred embodiment the extraneous locking element is long enough such that when inserted into the channel formed by the transverse coupling means it can be inserted into corresponding longitudinal grooves of panels on both sides of the channel. Thereby, the extraneous locking element is inserted in two longitudinal grooves, thereby providing support for interconnection zones in between four panels.

During assembly of a surface covering, it is often necessary to disassemble and reassemble panels. Further, it can be necessary to completely disassemble a surface covering e.g. for reconstruction purposes or the like. Therefore, it can be necessary to reuse extraneous locking elements several times, which can be problematic if upon insertion or removal of the extraneous locking element into or out of the channel, the extraneous locking element is subject to excessive friction. In addition, upon insertion of the extraneous locking element into the channel, friction can hamper the assembly process of the surface covering.

In order to reduce problems caused by friction between the extraneous locking element and the channel, in a preferred embodiment the extraneous locking element is an essentially bar-shaped element with an essentially rectangular cross section, wherein at least one outer surface of the extraneous locking element is provided with a structure to reduce friction upon insertion. The rectangular cross-section is advantageous in that the resulting essentially flat surfaces provide an easy insertion. The structure on the outer surface comprises advantageously wave-shaped protrusions. As it will be clear to the person skilled in the art, the cross-section is not provided in a mathematically rectangular shape. For example the edges of the cross-section can be rounded, or can be beveled, or the cross-section can be even essentially oval. To facilitate insertion of the extraneous locking element into the channel, preferably an end portion of the extraneous locking element is tapered towards one of its free ends. For the same purpose, in a preferred embodiment, an end portion of the extraneous locking element has a conical shape which also is tapered towards a free end of the extraneous locking element. In a preferred embodiment, the extraneous locking element is made of plastic, a wooden composite or metal. The extraneous locking element can also be made from wood, although preferably the extraneous locking element is not made from wood.

Due to the inventive support provided by the extraneous locking element the installed panels are more flush with each other, i.e. the occurrence of height differences leading to small steps between neighboring panels is reduced. This in turn allows the provision of decorative seems which can be for example milled into the panel surface at the edges of the panels, since an unevenness in height severely reduced the optical pleasing appearance of such decorative seems. Thus, in a preferred embodiment, the panels are provided with visible connection edges at the longitudinal sides and/or at the transverse sides which are beveled such that when the panels are connected to corresponding panels, respective corresponding visible edges have a for example v-shaped cross-section. As it is clear to the person skilled in the art, such a decorative connection edge can be provided also with different cross-sections such as rounded or rectangular cross-sections. Preferably, the visible surface of the panels is provided with a decorative seem. Such a decorative seem can be for example a rectangular groove milled into the surface of a panel, exemplarily provided with a colored coating, or a seem mimicking the appearance of a tile structure.

According to the invention, a method for laying a floor covering is provided which comprises the following steps, however not necessary in the given order: First, a surface covering according to the invention is provided. Then a first row of panels is laid, whereby corresponding neighboring panels are connected at corresponding transverse edges by vertical folding. Following the laying of the panels, extraneous locking elements are inserted into channels in between respective neighboring panels before a second row of panels is provided parallel to the first row, whereby each panel of the second row is connected to the first row by angling. Obviously, it is also possible to couple first the second row and to insert the locking elements afterwards. In any case, the extraneous locking elements, which are inserted into corresponding channels of the first row, are inserted at least partially into corresponding grooves of the second row. Next, further extraneous locking elements are inserted into corresponding channels of the second row, whereby these extraneous locking elements are also at least partially inserted into grooves of the first row. These steps are continued with additional rows of panels.

Even though the method has been described in the context of laying a floor covering, it will be clear to the person skilled in the art that the same method is applicable for example to assemble a wall or a ceiling covering.

The invention also relates to an extraneous locking element for the locking of at least two flooring panels. This element, which preferably can be used in connection with a surface covering as described above, is especially advantageous in that it can reduce the problems associated with insertion of the elements caused by friction. Friction can be in particular problematic if during assembly of a surface covering it becomes necessary to disassemble and reassemble panels. Further, it can become problematic if the surface covering has to be completely disassembles e.g. for reconstruction purposes or the like. In addition, upon insertion of the extraneous locking element into the channel friction hampers even the first assembly process of the surface covering.

To reduce said friction, according to the invention, the extraneous locking element is an essentially bar-shaped element with an essentially rectangular cross section, wherein at least one outer surface of the extraneous locking element is provided with a structure to reduce friction upon insertion. In a preferred embodiment, the structure comprises wave-shaped protrusions. In a further preferred embodiment, the structure comprises at least two protruding ribs or fins extending in the longitudinal direction of the extraneous locking element. The ribs can be provided in addition or alternatively to the wave-shaped protrusions, however the structure is provided such that the total area of a contact surface, i.e. the area of the surface of the extraneous locking element which is in contact with the channel when the extraneous locking element is inserted into the channel is reduced as compared to a surface without this structure.

To further facilitate the insertion of the extraneous locking element into the channel, preferably an end portion of the extraneous locking element is tapered towards a free end of the extraneous locking element. Alternatively, in a preferred embodiment the extraneous locking element is provided with beveled edges to facilitate insertion of the extraneous locking element. Preferably, an end portion of the extraneous locking element has a conical shape which is tapered towards a free end of the extraneous locking element.

In a preferred embodiment, the ratio between the height of the side edge of the extraneous locking element and the width of the upper edge of the extraneous locking element is in between 0.1 and 0.6, more preferably in between 0.15 and 0.55, even more preferably in between 0.2 and 0.5, yet even more preferably in between 0.25 and 0.45, and most preferably in between 0.3 and 0.4. This ratio is chosen to allow for optimal insertion of the extraneous locking element into the channel while offering at the same time sufficient mechanical rigidity with most suitable materials. Further, the effective thickness $d_{eff}$ of the extraneous locking element is preferably in between 1 mm to 5 mm, more preferably in between 1.3 mm to 3 mm, even more preferably in between 1.35 mm to 2 mm, and most preferably in between 1.4 mm to 1.5 mm. Further, this effective thickness $d_{eff}$ of the extraneous locking element is preferably chosen such that a portion of the extraneous locking element which extends into the groove of a panel is wedged, i.e. clamped, in between the lower lip contact portion and the upper lip contact portion.

In order to provide an optimal support for the panel surface as it has been described in detail above, preferably the ratio between the average width of the panels and the length of the extraneous locking element has to be chosen in a suitable way. Therefore, in a preferred embodiment the ratio between the mean width of the panels and the length L of the extraneous locking element is in between 0.9 and 0.998, preferably in between 0.97 and 0.99, but more preferably in between 0.95 and 0.985, even more preferably in between 0.955 and 0.98, yet even more preferably in between 0.965 and 0.982, and most preferably in between 0.97 and 0.98. Further, preferably the length L of the extraneous locking element is within a range of 50 mm to 800 mm, more preferably within a range of 75 mm to 700 mm, even more preferably within a range of 100 mm to 600 mm, yet even more preferably within a range of 100 mm to 550 mm, and most preferably within a range of 100 mm to 400 mm.

Even though the invention is described mainly for the case of panels with angling coupling means provided on one pair of opposing edges and vertical folding coupling means on the other pair of opposing sides, it should be noted that this combination of coupling means is not limiting to the invention and for example the transverse panel edges can be provided with different coupling means. Further, the terms longitudinal edge and transverse edge as used herein do not include any limitations with regard to the relative lengths of both edges but are merely used in order to differentiate the different edges of the panel for the sake of a facilitated description. Thus, while usually the longitudinal edge is the longer edge of a panel and the transversal edge is the shorter edge, the extraneous locking element of the present invention can of course also be used in connection with the longer edge of a panel or with panels in which longitudinal and transverse edges have the same length, i.e. with square panels.

4. DESCRIPTION OF THE PREFERRED EMBODIMENTS

In the following, the invention is described exemplarily with reference to the enclosed figures in which FIG. 1 shows a schematic view of three panels laid in a common plane, being not connected to each other;

Figure 9:
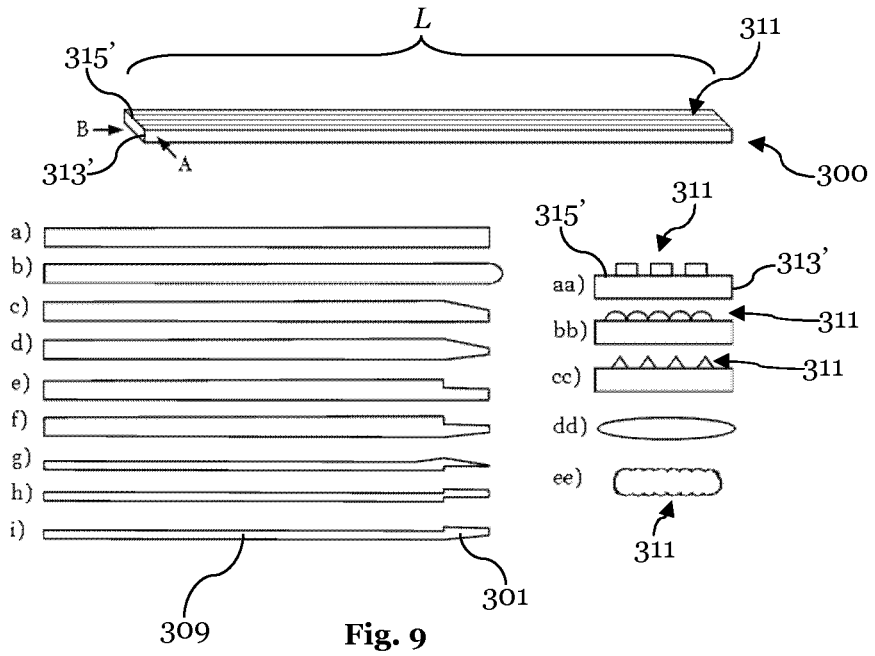
Figure 10:
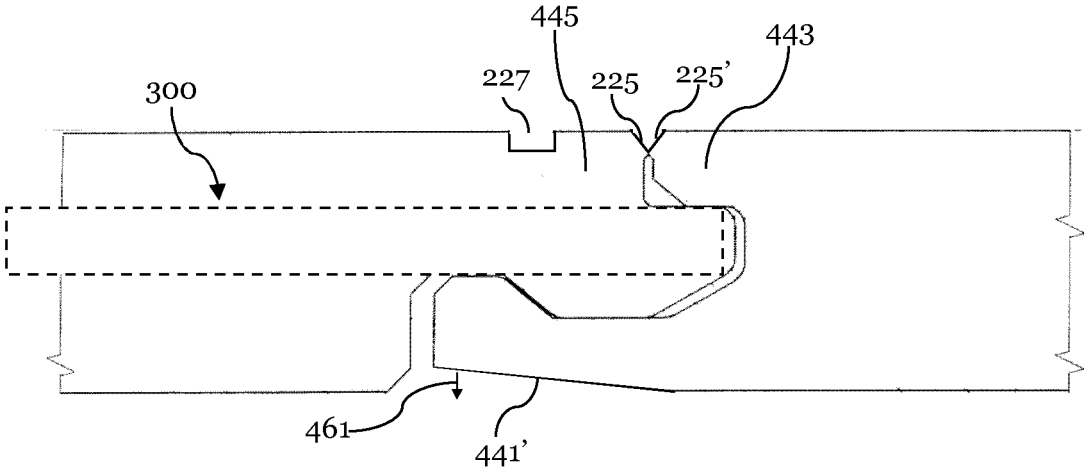

FIG. 9 shows the extraneous locking element whereby parts a) to i) show different embodiments of the end portions thereof and parts aa) to ee) show different embodiments of the cross-section of the extraneous locking element; and FIG. 10 shows a different embodiment of longitudinal coupling means in coupled condition, whereby an extraneous locking element is shown inserted into a groove of the longitudinal coupling means.

Figure 1:
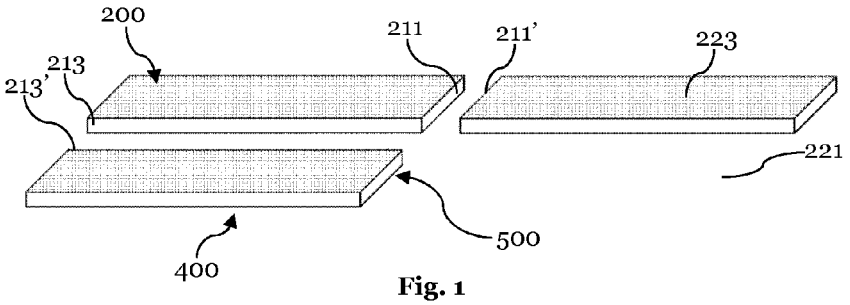

FIG. 1 is a schematic illustration showing three example panels 200 laid in a common plane 221. These panels 200 can be for example laminate panels made from HDF, MDF, OSB or the panels 200 can be made of a wood composite or real wood. The panels 200 have a mean or average thickness in between 3 mm and 30 mm, preferably a thickness in between 5 mm and 20 mm, more preferably in between 6 mm and 12 mm and most preferably in between 6 mm and 8 mm, and are provided with a decor 223 which can either be provided as a separate decor layer, e.g. a decor printed on paper, or which is directly printed onto the panels 200. The decor 223 can be for example a real wood imitation, a stone imitation, a ceramic imitation or the like.

As one can see in the FIG. 1, each panel 200 is provided with parallel, opposing longitudinal edges 213, 213' and parallel, opposing transverse edges 211, 211'. These edges are provided with respective longitudinal and transverse coupling means 400, 500 (shown in FIGS. 3 to 8 and 10) which are adapted to connect similar panels 200 at corresponding adjacent edges 213, 213' and 211, 211', respectively.

Figure 2:
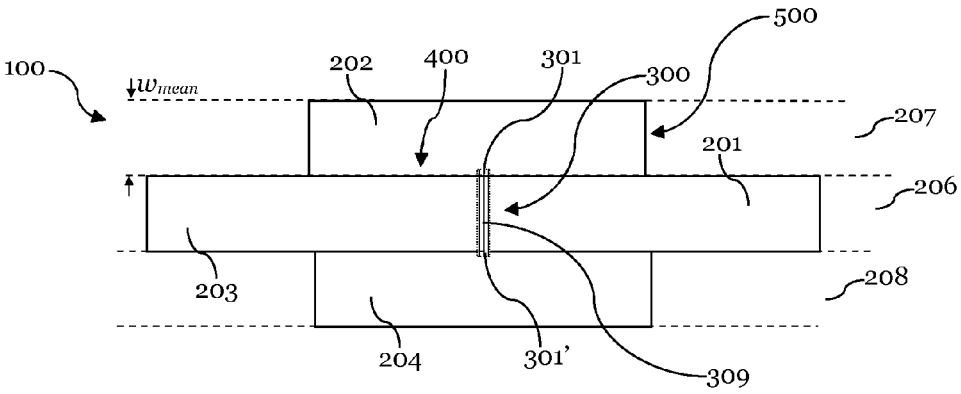
FIG. 2 is a schematic top view of a surface covering, whereby four panels are exemplarily shown connected to each other.

FIG. 2 is a schematic illustration showing a surface covering 100 comprising panels 201, 202, 203 and 204 and an extraneous locking element indicated at reference numeral 300. It should be noted that in the figure, the extraneous locking element is only drawn for illustrative purposes, while in reality it is covered by the top surface of the panels, and would therefore be invisible in the shown perspective. In FIG. 2, two panels 201, 203 of a first row 206 are connected to each other at adjacent transverse edges. The panels 201, 203 are connected longitudinally with a further panel 202 in a second row 207 and with a further panel 204 in a third row 208. As one can derive from FIG. 2, the extraneous locking element is inserted into a channel (the channel is shown in detail in FIG. 3) formed by the transversal coupling means of panels 201 and 203, whereby an end portion 301 of the extraneous locking element 300 protrudes on one end to some extend out of said channel and into the groove of the longitudinal coupling means of the panel 202 in the second row 207. In an alternative, also the opposite end 301' of the extraneous locking element 300 protrudes a little bit out of the other end of the channel. As the skilled person will recognize, panel 204 of the third row 208 is provided on the longitudinal connecting edge with panels 201, 203 with a tongue (the in FIG. 2 "upper" longitudinal edge of panels 201 and 203 is provided with a tongue and the opposing "lower" longitudinal edge with a corresponding groove), so that usually at this edge there would be no space for the insertion of end portion 301'. However, in the shown alternative, the tongue of panel 204 is interrupted in this area and instead provided with a suitable groove for the reception of the end portion 301'. Thereby, the extraneous locking element 300 can lock four panels with each other.

To allow for the end portion 301 of the extraneous locking element 300 to protrude into the longitudinal coupling means of the panels of row 207 as shown in FIG. 2, the length L of the extraneous locking element 300 is chosen to be essentially equal to a mean width $w_{mean}$ of the panels 200, and preferably slightly shorter. In a preferred embodiment, the ratio between the length L of the extraneous locking element 300 and the mean width $w_{mean}$ of the panels 200 (i.e. $L/w_{mean}$) is chosen in between 0.9 and 0.998, preferably in between 0.97 and 0.99, but more preferably in between 0.95 and 0.985, even more preferably in between 0.955 and 0.98, yet even more preferably in between 0.965 and 0.982, and most preferably in between 0.97 and 0.98. Typically, in a preferred embodiment, this ratio results in a length L of the extraneous locking element 300 being within a range of 50 mm to 800 mm, preferably within a range of 75 mm to 700 mm, more preferably within a range of 100 mm to 600 mm, even more preferably within a range of 100 mm to 550 mm, yet even more preferably within a range of 100 mm to 400 mm and most preferably between 120 and 380 mm.

The coupling means will be described in the following in more detail with reference to FIGS. 3 to 8 and 10.

Figure 3:
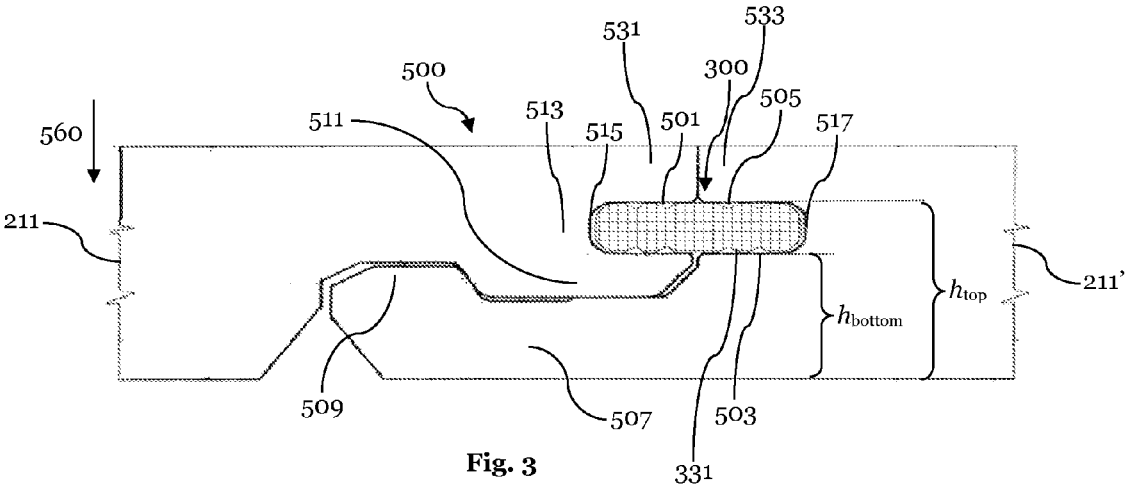
FIG. 3 shows a cross section of transverse coupling means in coupled condition, whereby an extraneous locking element is inserted into a channel formed by the transverse coupling means.

FIG. 3 shows a cross section of the transverse coupling means 500. As one can see, a transverse edge 211' is provided with a locking strip 507 with an upwardly directed locking member 509. The opposing transverse edge 211 is provided with a corresponding downwardly open transverse locking groove 511 and a transverse downward protrusion 513. These coupling means can be connected to each other by vertical folding, i.e. by a vertical lowering of edge 211 downwards along arrow 560 towards the edge 211'.

The transverse protrusion 513 is provided with a recess 515 and the opposite transverse edge 211 is provided with a corresponding counter recess 517, such that the recesses in combination form a channel 501, when two panels are connected to each other at corresponding transverse sides. The bottom of this channel is provided at a height $h_{bottom}$, while the top of the channel is provided at a height $h_{top}$ to allow for the extraneous locking element 300 to be inserted at a suitable height, as it will be explained below.

To completely lock the transverse connection between two panels, the extraneous locking element 300 is inserted into the channel 501, whereby the panels are locked perpendicular to adjacent transverse panel edges 211, 211' and parallel to the panel plane 221. As one can derive from FIG. 3, besides being part of the transverse locking mechanism, the extraneous locking element 300 provides support for the panel surface in particular at the top portions 531 and 533 of the transverse coupling means 500, whereby an inward, respectively downward bending of the panel surface is prevented.

The upper and lower surfaces of the extraneous locking element 300 is provided with a three-dimensional structure 331 which is in contact with the upper and lower wall of the channel. In the shown embodiment, this structure is formed by wave-shaped protrusions providing a smaller contact area compared to a flat surface. Thereby, the ratio between the area which is actually in contact with the channel walls and the full area of an outer surface of the extraneous locking element 300 is in between 0.1 and 0.99, preferably in between 0.12 and 0.95, more preferably in between 0.12 and 0.8, most preferably in between 0.15 and 0.75.

Figure 4:
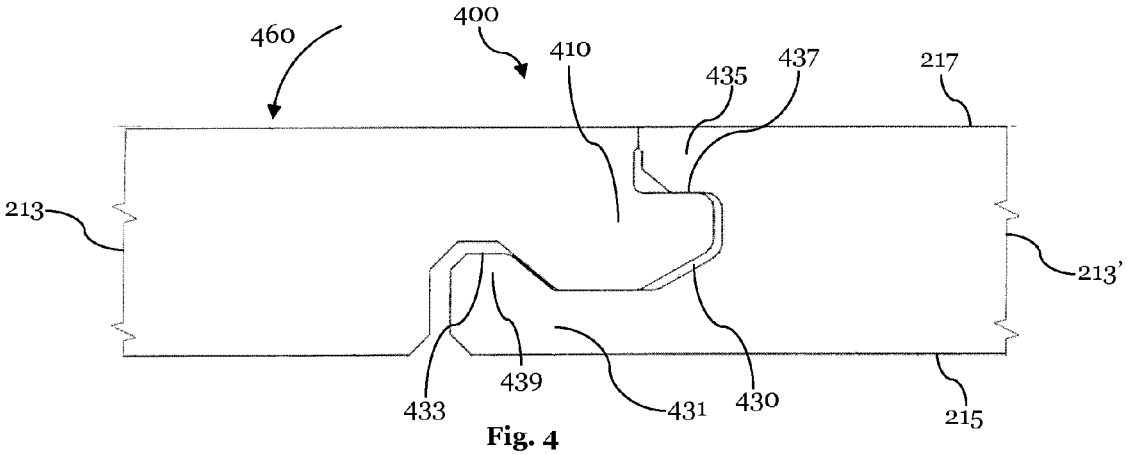
FIG. 4 shows a cross section of longitudinal coupling means in coupled condition.

FIG. 4 shows exemplary longitudinal coupling means 400 comprising a tongue 410 on one edge 213 and a corresponding groove 430 on the opposing edge 213'. The groove 430 comprises a lower lip 431 which is arranged close to a bottom side 215 of the panel 200 and an upper lip 435 which is arranged close to the upper side 217 of the panel which carries for example the visible decor. As one can see, and this arrangement is preferred with any kind of longitudinal coupling means used in connection with the present invention, the lower lip 431 is longer than the upper lip 435 and the lower lip 431 is provided with a locking protrusion 439 at its free end which extends upwardly from the lower lip 431 to be inserted into a corresponding recess.

As the person skilled will recognize from the figures, these coupling means can be closed by moving the tongue 410 into the groove 430 at an angle, and by subsequent rotation along arrow 460. After this rotation, the locking element 439 fixes the mechanism such that the corresponding panels are locked perpendicular to adjacent longitudinal edges 213 and perpendicular to the plane of the panels as well as parallel to the plane of the panels As the skilled person recognizes from FIG. 5, the tongue of the left panel in FIG. 5 does not extend to the corner of the panel but ends a few millimeters before the corner. Thereby, the extraneous locking element can protrude to some extend out of the channel at the corner of the panel.

Figure 5:
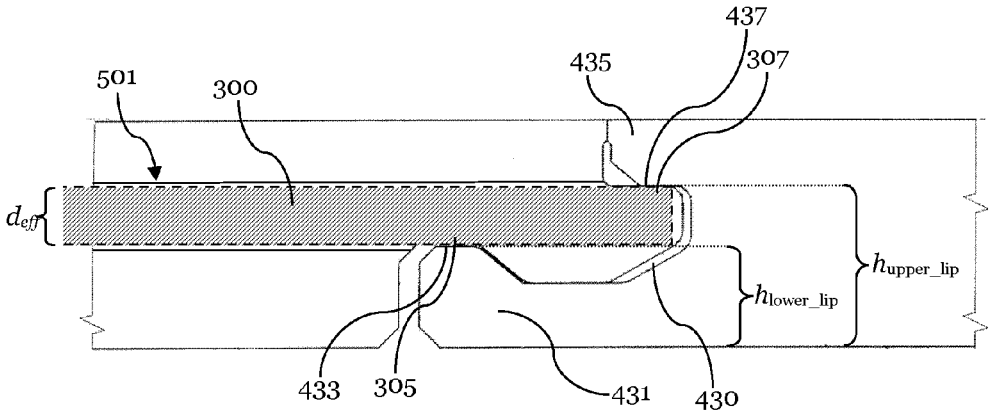
FIG. 5 is a schematic cross sectional view showing the longitudinal coupling means of FIG. 4 in coupled condition, whereby an extraneous locking element is shown inserted into a groove of the longitudinal coupling means.

As one can derive from FIGS. 4 and 5, upon insertion of the extraneous locking element 300 into the groove 430, a lower surface 305 (see FIG. 5) of the extraneous locking element 300 engages a lower lip contact portion 433 (provided at height $h_{lower_lip}$), while an upper surface 307 of the extraneous locking element 300 engages an upper lip contact portion 437 (provided at height $h_{upper_lip}$) to wedge the extraneous locking element 300 into the groove 430. To allow the insertion of the extraneous locking element the height $h_{lower_lip}$ of the lower lip contact portion 433 is chosen to be essentially at the same height as a height the height $h_{bottom}$ of the bottom of the channel (see FIG. 3). Similarly, the height $h_{upper_lip}$ of the upper lip contact portion 437 is chosen to be essentially at the same height as the height $h_{top}$ of the top of the channel.

Figure 6:
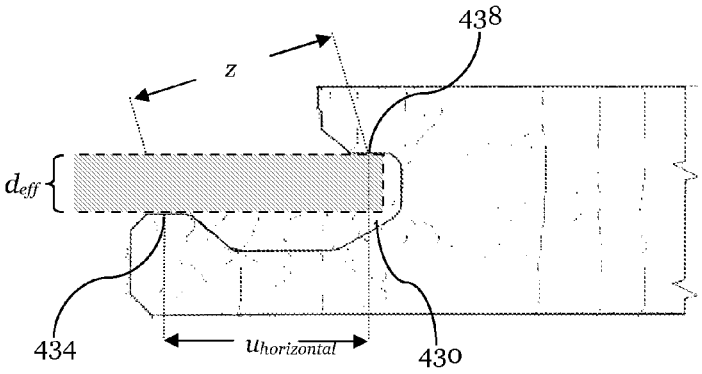
FIG. 6 shows the groove of FIG. 5 and the inserted extraneous locking element of FIG. 5.

To assure that the extraneous locking element can be suitably arranged inside of the groove 430, it is advantageous to provide the extraneous locking element, or at least the portion of the extraneous locking element 300 which is inserted into the groove, with a suitable thickness, which is referred to as an effective thickness $d_{eff}$. As shown in FIG. 6, it is advantageous if this thickness is chosen in relation to a horizontal length $u_{horizontal}$ of the lower lip, which is the length of the lip as measured in between a center 434 of the lower lip contact portion 433 and a center 438 of the upper lip contact portion 437 and a distance z between these centers 434 and 438. As a result, the effective thickness $d_{eff}$ can be chosen in relation to the length $u_{horizontal}$ and the distance z, according to Pythagorean theorem, i.e. to the formula $d_{eff}=\sqrt{z^2-u_{horizontal}^2}$. Said horizontal length $u_{horizontal}$ of the lower lip typically is within a range of 0.1 mm to 20 mm, more preferably within a range of 2 mm to 15 mm, even more preferably within a range of 3 mm to 12 mm, and most preferably within a range of 4 mm to 8 mm.

Figure 7:
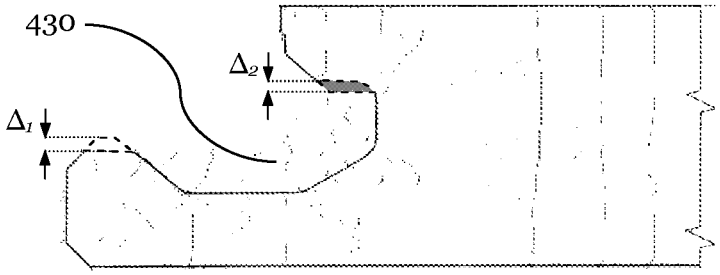
FIG. 7 shows details of the groove of FIGS. 5 and 6.

Further, in order to assure a suitable arrangement of the extraneous locking element 300 inside of the groove 430, it can be advantageous if height $h_{lower_lip}$ of the lower lip contact portion 433 is chosen to be slightly higher than the height $h_{bottom}$ of the bottom 503 of the channel. As illustrated in FIG. 7, therefore, the lower lip contact portion 433 can be provided with a small elevation of additional height $\Delta_1$, i.e. the height $h_{lower_lip}$ is preferably chosen at a height $h_{bottom}+\Delta_1$, wherein $\Delta_1$ is within a range of 0.01 mm to 0.8 mm, more preferably within a range of 0.1 mm to 0.7 mm, even more preferably 0.15 mm to 0.65 mm, still more preferably within a range of 0.2 mm to 0.6 mm, and most preferably within a range of 0.3 mm to 0.5 mm.

Alternatively or in addition it can be advantageous if height $h_{upper_lip}$ of the upper lip contact portion 437 is chosen to be slightly lower than the height $h_{top}$ of the top 505 of the channel, As also illustrated in FIG. 7, therefore, the lower lip contact portion 437 can be provided with a small protrusion of lowering the height $h_{upper_lip}$ by an amount $\Delta_2$, i.e. the height $h_{upper_lip}$ is preferably chosen to be at a height $h_{top}-\Delta_2$, wherein $\Delta_2$ is within a range of 0.01 mm to 0.8 mm, more preferably within a range of 0.1 mm to 0.7 mm, even more preferably 0.15 mm to 0.65 mm, still more preferably within a range of 0.2 mm to 0.6 mm, and most preferably within a range of 0.3 mm to 0.5 mm.

Figure 8:
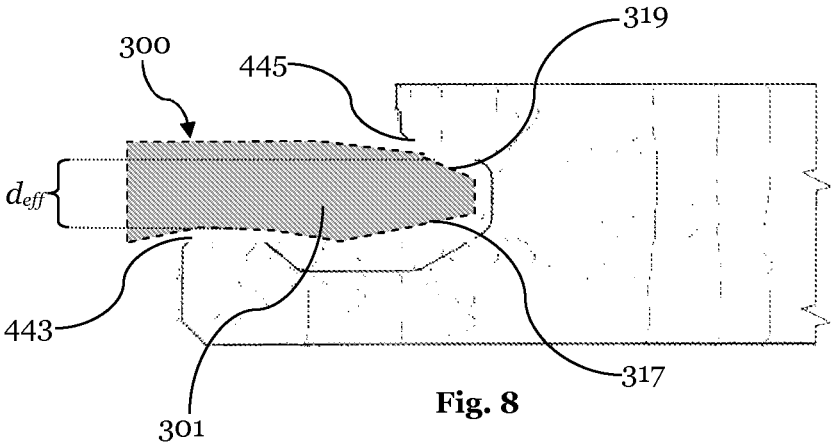
FIG. 8 shows the groove of FIGS. 5, 6 and 7 and a different embodiment of the extraneous locking element.

The effect of these height differences can best be understood from considering FIG. 8. Upon insertion of the extraneous locking element 300 into groove 430 of the longitudinal coupling means 400, a lower surface of the extraneous locking element 300 engages the lower lip contact portion 433 causing the extraneous locking element 300 to be (slightly) deflected upwards and upon continuation of insertion, an upper surface of the extraneous locking element 300 engages the upper lip contact portion causing the extraneous locking element 300 to be deflected downwards. By this deflection, which is in reality not visible to the naked eye and shown exaggerated in FIG. 8 for illustrative purposes, the end portion 301 of the extraneous locking element 300 is wedged in between the contact portions 433, 437 such that the extraneous locking element is fixedly attached to the groove 430, thereby providing a particularly firm locking of the three panels coupled thereby (as e.g. panels 201, 203 and 202 in the example of FIG. 2). To facilitate the insertion of the extraneous locking element 300 into groove 430, the end portions 301 can be provided with beveled edges 319, 317 as visible in FIG. 8, tapered towards a free end of the extraneous locking element 300 or provided with a conical shape.

Different embodiments of end portions 301 are shown in FIG. 9, parts a) to i). Obviously, both ends of the extraneous locking element 300 can be provided with the same shape, so that a user does not unintentionally insert the wrong end of the locking element into the channel. To further facilitate insertion of the extraneous locking element 300 into groove 430, the groove 430 can be provided with beveled edges 445, 443. In the preferred embodiments shown in FIG. 9, the extraneous locking element 300 is an essentially bar-shaped element with an essentially rectangular cross section, wherein at least one outer surface 315 of the extraneous locking element 300 is provided with a structure 311 to reduce friction upon insertion. Parts aa) to ee) of FIG. 9 show different embodiments of suitable structures provided on the extraneous locking element 300 and suitable cross-sections of the extraneous locking element 300. As one can see, suitable structures may be wave-shaped protrusions or rectangular ribs. Also triangular or round ribs are possible (whereby rectangular and triangular are of course not to be understood in a strict mathematical sense). However, as it will be clear to the skilled person, this list is not concluding and different cross-sections of the extraneous locking element 300 are possible.

Referring back to FIG. 8, it will be appreciated by the skilled person that the effective thickness $d_{eff}$ of the extraneous locking element 300 does not need to be a total or actual thickness of the extraneous locking element 300. As shown in FIG. 8, the effective thickness $d_{eff}$ of the extraneous locking element 300 is chosen such that the end portion 301 which extends into the groove 430 of a panel 200 is in contact with the lower lip contact portion 433 and the upper lip contact portion 437. Thus, the effective thickness $d_{eff}$ is the thickness of the extraneous locking element 300 when inserted in between the contact portions 433, 437, as measured in between these portions perpendicular to plane 221. Typically, the effective thickness $d_{eff}$ is chosen is in between 1 mm to 5 mm, more preferably in between 1.3 mm to 3 mm, even more preferably in between 1.35 mm to 2 mm, and most preferably in between 1.4 mm to 1.5 mm.

To facilitate insertion of the extraneous locking element 300 into the channel and provide optimal friction conditions, it is advantageous if the cross-section, i.e. the ratio between the longer side 315 and the shorter side 313 of this cross-section are chosen appropriately. Advantageously, therefore the ratio between the height of the side edge 313 and the width of the upper edge 315 (i.e. height/width) is in between 0.1 and 0.6, more preferably in between 0.15 and 0.55, even more preferably in between 0.2 and 0.5, yet even more preferably in between 0.25 and 0.45, and most preferably in between 0.3 and 0.4. Typically, the width of the upper edge 315 is chosen within a range of 2 mm to 10 mm, more preferably within a range of 3 mm to 7 mm, even more preferably within a range of 3.5 mm to 6 mm, yet even more preferably within a range of 3.7 mm to 5 mm, and most preferably within a range of 4.1 mm to 4.3 mm.

FIG. 10 shows a different embodiment of the longitudinal coupling means 400. As one can see in this figure, the underside 441 of the lower lip 431 is inclined to allow a downwards bending of the lower lip 431 (arrow 461) to facilitate insertion of the tongue 410 into the groove 430. Further, one can see in this figure that the panels 200 are provided with visible connection edges 225, 225' at the longitudinal sides (which can also be provided alternatively or in addition at the transverse sides) which are provided for decorative purposes, imitating e.g. the joints of tiles. The upper parts of the edges are beveled such that when corresponding panels are connected, respective corresponding visible edges 225, 225' have a v-shaped cross-section. Further, the visible surface of the panels could be provided with a decorative seem 227. As one can see in this figure, the extraneous locking element 300 provides support for the portions 445, 443 of the longitudinal coupling means 400 preventing a bending of the panel surface downwards. Thereby, the surfaces of the two joint panels are particularly flush, which in particular improves the optical quality of such decoration elements as the optically visible v-shaped groove 225, 225' or the decorative seem 227.

To protect the panel surface, the panels 200 can be provided with a transparent protective coating which can further comprise abrasion-resistant particles. This transparent protective coating can be a polymer coating provided with a hardness gradient, so that the hardness of the polymer coating substantially continuously decreases with increasing depth when viewed from the surface of the coating.

The invention claimed is:

1. A surface covering comprising panels and at least one extraneous locking element, each panel provided with parallel, opposing longitudinal edges and parallel, opposing transverse edges, these edges being provided with respective longitudinal and transverse coupling means which are adapted to connect similar panels at corresponding adjacent edges, whereby the transverse coupling means are adapted to lock panels perpendicular to adjacent transverse panel edges and parallel to the panel plane, the transverse coupling means in coupled condition forming a channel which is adapted to receive the extraneous locking element, the longitudinal coupling means comprise a tongue on one edge and a corresponding groove on the opposing edge, the longitudinal coupling means being adapted to lock similar panels perpendicular to adjacent longitudinal edges and perpendicular to the plane of the panels as well as parallel to the plane of the panels, whereby the longitudinal coupling means are adapted to be locked with angling and the transverse coupling means are adapted to be locked with vertical folding, wherein a lower lip of the groove is provided with a lower lip contact portion positioned at a lower lip contact portion height $h_{lower_lip}$, and an upper lip of the groove is provided with an upper lip contact portion positioned at an upper lip contact portion height $h_{upper_lip}$, whereby the difference between these heights $h_{upper_lip}-h_{lower_lip}$ is equal to an effective thickness $d_{eff}$ of the extraneous locking element, such that when two parallel rows of panels are assembled, the extraneous locking element, when inserted into the channel formed by the transverse coupling means of panels in the first row, is adapted to extend at least partially into the groove of an adjacent parallel panel in the second row, such that a lower surface of the extraneous locking element is in contact with the lower lip contact portion, and the upper surface of the extraneous locking element is in contact with the upper lip contact portion.

2. The surface covering according to claim 1, wherein a bottom of the channel is at a height $h_{bottom}$, which is at the same height as a height $h_{lower_lip}$ of the lower lip contact portion, and a top of the channel is at a height $h_{top}$ which is at the same height as a height $h_{upper_lip}$ of the upper lip contact portion.

3. The surface covering according to claim 1, wherein the effective thickness $d_{eff}$ of the extraneous locking element is chosen such that a portion of the extraneous locking element which extends into the groove of a panel is wedged in between the lower lip contact portion and the upper lip contact portion.

4. The surface covering according to claim 1, wherein a bottom of the channel formed by the transverse coupling means is at a height $h_{bottom}+\Delta 1$, wherein $\Delta 1$ is within a range of 0.01 mm to 0.8 mm and the lower lip contact portion height $h_{lower_lip}$ is at the same height.

5. The surface covering according to claim 1, wherein a top of the channel formed by the transverse coupling means is at a height $h_{top}-\Delta 2$, wherein $\Delta 2$ is within a range of 0.01 mm to 0.8 mm and the upper lip contact portion height $h_{upper_lip}$ is at the same height.

6. The surface covering according to claim 1, wherein the extraneous locking element is adapted to couple three panels to each other.

7. The surface covering according to claim 1, wherein the extraneous locking element comprises a contact surface which is adapted to contact the channel when the extraneous locking element is inserted into the channel, whereby the ratio between the area of the contact surface and the area of an outer surface of the extraneous locking element is in between 0.1 and 0.99.

8. The surface covering according to claim 1, wherein the length L of the extraneous locking element is equal to a mean width wmean of the panels, whereby the ratio $L/w_{mean}$ between the length L of the extraneous locking element and the mean width $w_{mean}$ of the panels is in between 0.9 and 0.998.

9. The surface covering according to claim 1, wherein the length L of the extraneous locking element is within a range of 50 mm to 800 mm.

10. The surface covering according to claim 1, wherein the extraneous locking element is a bar-shaped element with a rectangular cross section, wherein at least one outer surface of the extraneous locking element is provided with a structure to reduce friction upon insertion.

11. The surface covering according to claim 10, wherein the structure comprises wave-shaped protrusions to reduce friction between the extraneous locking element and the channel upon insertion.

12. The surface covering according to claim 10, wherein the structure comprises at least two protruding ribs or fins extending in the longitudinal direction of the extraneous locking element.

13. The surface covering according to claim 10, wherein the ratio between the height of the side edge and the width of the upper edge of the extraneous locking element is in between 0.1 and 0.6.

14. The surface covering according to claim 10, wherein the width of the upper edge is within a range of 2 mm to 10 mm.

15. The surface covering according to claim 1, wherein, when two parallel rows of panels are assembled, and the extraneous locking element is inserted into the channel formed by the transverse coupling means of panels in the first row, an end portion of the extraneous locking element extends at least partially into the groove of an adjacent parallel panel in the second row of panels, whereby an effective thickness $d_{eff}$ of said end portion is equal to the difference $h_{upper_lip}-h_{lower_lip}$ between the height $h_{lower_lip}$ of the lower lip contact portion and the height $h_{upper_lip}$ of the upper lip contact portion, and whereby the effective thickness deff of said end portion is different than a thickness of an intermediate portion of the extraneous locking element.

16. The surface covering according to claim 1, wherein an end portion of the extraneous locking element is tapered towards a free end of the extraneous locking element.

17. The surface covering according to claim 1, wherein an end portion of the extraneous locking element has a conical shape which is tapered towards a free end of the extraneous locking element.

18. The surface covering according to claim 1, wherein the extraneous locking element is not made from wood.

19. The surface covering according to claim 1, wherein the effective thickness deff of the extraneous locking element is in between 1 mm to 5 mm.

20. The surface covering according to claim 1, wherein the lower lip extends further than the upper lip, whereby the mean horizontal distance uhorizontal between the contact portions is chosen in relation to a mean distance z between the contact portions and the effective thickness deff of the extraneous locking element according to the formula $u_{horizontal}=\sqrt{d_{eff}^2+z^2}$.

21. The surface covering according to claim 1, wherein the mean horizontal distance uhorizontal between the contact portions is within a range of 0.1 mm to 20 mm.

22. The surface covering according to claim 1, wherein a longitudinal edge of a first panel in a first row of panels is adapted to be connected to a longitudinal edge of a second panel in a second row of panels by angling, and whereby a transverse edge of the first panel and a transverse edge of a third panel in the first row are adapted to be connected with the same angle motion.

23. The surface covering according to claim 1, wherein the lower lip is arranged at bottom side of the panel and is longer than the upper lip, the lower lip further being provided with a locking protrusion at its free end which extends upwardly from the lower lip.

24. The surface covering according to claim 23, wherein the lower lip contact portion is provided on the locking protrusion.

25. The surface covering according to claim 1, wherein the underside of the lower lip is inclined to allow a downwards bending of the lower lip to facilitate insertion of the tongue into the groove.

26. The surface covering according to claim 1, wherein upon at least partial insertion into the groove, the extraneous locking element is adapted such that a lower surface of the extraneous locking element engages the lower lip contact portion causing the extraneous locking element to be deflected upwards and upon continuation of insertion, the upper surface of the extraneous locking element engages the upper lip contact portion causing the extraneous locking element to be deflected downwards.

27. The surface covering according to claim 26, wherein the lower lip contact portion is provided with a first bevelled edge and the upper lip contact portion is provided with a second bevelled edge to facilitate the deflections of the extraneous locking element when the extraneous locking element is inserted at least partially into the groove.

28. The surface covering according to claim 1, wherein the transverse coupling means comprise a locking strip with an upwardly directed locking member on one edge and a downwardly open transverse corresponding locking groove at the opposite edge for connecting adjacent transverse edges of similar panels in a direction perpendicular to the adjacent edges and parallel to the plane of the panels.

29. The surface covering according to claim 28, wherein the downwardly open transverse locking groove of the transverse coupling means is formed in a transverse protrusion, which extends in a plane parallel to the plane of the panel away from the transverse edge.

30. The surface covering according to claim 29, wherein the transverse protrusion is provided with a recess and the corresponding opposite transverse edge is provided with a corresponding counter recess, whereby the recesses form the channel when two panels are connected to each other at corresponding transverse sides.

31. The surface covering according to claim 1, wherein the panels are laminate panels comprising HDF, MDF, OSB or are made of wood.

32. The surface covering according to claim 1, wherein a décor is directly printed onto the panels or in that the panels are provided with a wood veneer.

33. The surface covering according to claim 1, wherein the panels are provided with a transparent protective coating, which comprises abrasion-resistant particles.

34. The surface covering according to claim 1, wherein the transparent protective coating is a polymer coating provided with a hardness gradient, so that the hardness of the polymer coating substantially continuously decreases with increasing depth viewed from the surface of the coating.

35. The surface covering according to claim 1, wherein the panels are provided with a decor, which is a real wood imitation, a stone imitation or a ceramic imitation.

36. The surface covering according to claim 1, wherein the longitudinal and the transverse coupling means are formed as integral parts of the panels.

37. The surface covering according to claim 1, wherein the panels have a mean thickness in between 3 mm and 30 mm.

38. The surface covering according to claim 1, wherein the extraneous locking element is made of plastic, a wood composite material or metal.

39. The surface covering according to claim 1, wherein the panels are provided with visible decorative connection edges at the longitudinal sides and/or at the transverse sides which are beveled such that when the panels are connected to corresponding panels, respective corresponding decorative visible edges have a v-shaped cross-section.

40. The surface covering according to claim 1, wherein the visible surface of the panels is provided with a decorative seem.

41. A surface covering comprising panels and at least one extraneous locking element, each panel provided with parallel, opposing longitudinal edges and parallel, opposing transverse edges, these edges being provided with respective longitudinal and transverse coupling means which are adapted to connect similar panels at corresponding adjacent edges, whereby the transverse coupling means are adapted to lock panels perpendicular to adjacent transverse panel edges and parallel to the panel plane, the transverse coupling means in coupled condition forming a channel which is adapted to receive the extraneous locking element, the longitudinal coupling means comprise a tongue on one edge and a corresponding groove on the opposing edge, the longitudinal coupling means being adapted to lock similar panels perpendicular to adjacent longitudinal edges and perpendicular to the plane of the panels as well as parallel to the plane of the panels, whereby the longitudinal coupling means are adapted to be locked with angling and the transverse coupling means are adapted to be locked with vertical folding, wherein when two parallel rows of panels are assembled, the channel formed by the transverse coupling means of panels in the first row is adapted, that upon insertion of the extraneous locking element into the channel between panels of the first row, the channel will guide the extraneous locking element at least partially into a groove of an adjacent parallel panel in the second row of panels, whereby a lower surface of the extraneous locking element engages a lower lip contact portion provided at the lower lip of said groove and an upper surface of the extraneous locking element engages an upper lip contact portion provided at an upper lip of said groove.

42. A method for laying a floor covering comprising the following steps:

1.) providing the surface covering according to claim 1;

2.) laying a first row of panels, whereby corresponding neighboring panels are connected at corresponding transverse edges by vertical folding;

3.) inserting the extraneous locking element into channels in between respective neighboring panels;

4.) providing a second row of panels parallel to the first row, whereby each panel of the second row is connected to the first row by angling, whereby the extraneous locking elements, which are inserted into corresponding channels of the first row are inserted at least partially into corresponding grooves of the second row;

5.) inserting additional extraneous locking elements into corresponding channels of the second row, whereby extraneous locking elements are inserted into grooves of the first row.

6.) continuing steps 1.)-5.) with additional rows of panels.

43. An extraneous locking element for the locking of at least two flooring panels, to be used in connection with a surface covering according to claim 1, whereby the extraneous locking element is a bar-shaped element with a rectangular cross section, wherein at least one outer surface of the extraneous locking element is provided with a structure to reduce friction upon insertion.

44. A method for laying a floor covering comprising the following steps:

1.) providing an extraneous locking element according to claim 43;

2.) providing panels, each panel provided with parallel, opposing longitudinal edges and parallel, opposing transverse edges, these edges being provided with respective longitudinal and transverse coupling means which are adapted to connect to similar panels at corresponding adjacent edges, whereby the transverse coupling means are adapted to lock panels perpendicular to adjacent transverse panel edges and parallel to the panel plane, the transverse coupling means in coupled condition forming a channel which is adapted to receive the extraneous locking element, the longitudinal coupling means comprise a tongue on one edge and a corresponding groove on the opposing edge, the longitudinal coupling means being adapted to lock similar panels perpendicular to adjacent longitudinal edges and perpendicular to the plane of the panels as well as parallel to the plane of the panels, whereby the longitudinal coupling means are adapted to be locked with angling and the transverse coupling means are adapted to be locked with vertical folding, 3.) laying a first row of panels, whereby corresponding neighboring panels are connected at corresponding transverse edges by vertical folding;

4.) inserting an extraneous locking element into channels in between respective neighboring panels;

5.) providing a second row of panels parallel to the first row, whereby each panel of the second row is connected to the first row by angling, whereby the extraneous locking elements, which are inserted into corresponding channels of the first row are inserted at least partially into corresponding grooves of the second row;

6.) inserting extraneous locking elements into corresponding channels of the second row, whereby extraneous locking elements are inserted into grooves of the first row.

7.) continuing steps 1.)-6.) with additional rows of panels.

* * * * *